US011663955B2

(12) United States Patent
Cong et al.

(10) Patent No.: US 11,663,955 B2
(45) Date of Patent: May 30, 2023

(54) PIXEL CIRCUIT, DRIVE METHOD THEREOF, DISPLAY SUBSTRATE, AND DISPLAY DEVICE

(71) Applicants: Beijing BOE Display Technology Co., Ltd., Beijing (CN); BOE Technology Group Co., Ltd., Beijing (CN)

(72) Inventors: Ning Cong, Beijing (CN); Minghua Xuan, Beijing (CN); Can Zhang, Beijing (CN); Ming Yang, Beijing (CN); Can Wang, Beijing (CN); Angran Zhang, Beijing (CN); Hao Chen, Beijing (CN); Xiaochuan Chen, Beijing (CN)

(73) Assignees: Beijing BOE Display Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 91 days.

(21) Appl. No.: 17/433,244

(22) PCT Filed: Feb. 7, 2021

(86) PCT No.: PCT/CN2021/075716

§ 371 (c)(1),
(2) Date: Aug. 24, 2021

(87) PCT Pub. No.: WO2021/190183

PCT Pub. Date: Sep. 30, 2021

(65) Prior Publication Data

US 2022/0343835 A1 Oct. 27, 2022

(30) Foreign Application Priority Data

Mar. 23, 2020 (CN) ..... 202010209937.5

(51) Int. Cl.
*G09G 3/32* (2016.01)

(52) U.S. Cl.
CPC ..... *G09G 3/32* (2013.01); *G09G 2300/0426* (2013.01); *G09G 2310/0278* (2013.01); *G09G 2310/08* (2013.01)

(58) Field of Classification Search
CPC ..... G09G 3/32; G09G 2300/0426; G09G 2310/0278; G09G 2310/08;
(Continued)

(56) References Cited

U.S. PATENT DOCUMENTS

2004/0066358 A1 4/2004 Numao
2014/0375700 A1* 12/2014 Takahama ..... G09G 3/2003 345/77

(Continued)

FOREIGN PATENT DOCUMENTS

CN 108538241 A 9/2018
CN 109872680 A 6/2019

(Continued)

OTHER PUBLICATIONS

International Search Report for PCT/CN2021/075716 dated Apr. 27, 2021.

(Continued)

*Primary Examiner* — Andrew Sasinowski
(74) *Attorney, Agent, or Firm* — Ling Wu; Stephen Yang; Ling and Yang Intellectual Property

(57) ABSTRACT

A pixel circuit, a drive method, a display substrate, and a display device are provided. The pixel circuit includes a light emitting device, a current supply sub-circuit, and a time control sub-circuit. The current supply sub-circuit is connected to a scanning signal terminal, a data signal terminal, a light emitting control terminal, a first power voltage terminal, the time control sub-circuit, and the light emitting device, and is configured to receive a data voltage of the data signal terminal and provide a drive current for the light
(Continued)

emitting device. The time control sub-circuit is connected to the scanning signal terminal, a time length signal terminal, a second power voltage terminal, a direct current control signal terminal, and a direct current voltage terminal, and is configured to receive a time length voltage of the time length signal terminal and a direct current voltage input by the direct current voltage terminal.

17 Claims, 14 Drawing Sheets

(58) Field of Classification Search
CPC ... G09G 2300/0842; G09G 2300/0861; G09G 2310/0259; G09G 2320/043; G09G 2320/064; G09G 3/3241; G09G 3/3208; H05B 44/00
See application file for complete search history.

(56) References Cited

U.S. PATENT DOCUMENTS

2015/0248149 A1* 9/2015 Yamazaki ..... G06F 1/1635 361/679.27
2016/0070386 A1* 3/2016 Yamamoto ..... G06F 3/04166 345/174
2016/0224175 A1* 8/2016 Moon ..... G06F 3/0412
2016/0353539 A1 12/2016 Li et al.
2018/0075798 A1* 3/2018 Nho ..... G09G 3/32
2018/0374415 A1* 12/2018 Morita ..... G09G 3/3266
2019/0378459 A1* 12/2019 Kim ..... G09G 3/3291
2020/0168156 A1* 5/2020 Yin ..... G09G 3/3258
2021/0027699 A1 1/2021 Zheng et al.
2021/0174736 A1 6/2021 Yang et al.
2021/0201760 A1 7/2021 Wang et al.
2021/0366364 A1 11/2021 Xuan et al.
2021/0375210 A1 12/2021 Xuan et al.

FOREIGN PATENT DOCUMENTS

CN 109920371 A 6/2019
CN 109979378 A 7/2019
CN 110010057 A 7/2019
CN 110310594 A 10/2019
CN 110491335 A 11/2019

OTHER PUBLICATIONS

Office Action dated Feb. 24, 2022 for Chinese Patent Application No. 202010209937.5 and English Translation.

* cited by examiner

PIXEL CIRCUIT, DRIVE METHOD THEREOF, DISPLAY SUBSTRATE, AND DISPLAY DEVICE

CROSS-REFERENCE TO RELATED APPLICATIONS

The present application is a U.S. National Phase Entry of International Application PCT/CN2021/075716 having an international filing date of Feb. 7, 2021, which claims priority of Chinese patent application No. 202010209937.5, filed on Mar. 23, 2020, and entitled "Pixel Circuit, Drive Method Thereof, Display Substrate, and Display Device", the contents of which should be construed as being hereby incorporated by reference in their entirety.

TECHNICAL FIELD

Embodiments of the present disclosure relate, but not limited, to the technical field of display, and particularly to a pixel circuit, a method for driving the pixel circuit, a display substrate, and a display device.

BACKGROUND

Micro inorganic light emitting diode, i.e., a light emitting diode miniaturization and arraying technology, refers to a high-density minute-sized light emitting diode array integrated on a chip. Micro inorganic light emitting diode attracts extensive attention due to its high luminance, high efficiency, quick response, small size, long service life, and many other advantages.

However, under a low current density, light emitting efficiency of a micro inorganic light emitting diode changes with the current density, and its color coordinates also change with the current density. At present, there is yet no mature display driving solution for micro inorganic light emitting diodes.

SUMMARY

The following is a summary of the subject matter described in the present disclosure in detail. The summary is not intended to limit the scope of protection of the claims.

An embodiment of the present disclosure provides a pixel circuit, which includes a light emitting device, a current supply sub-circuit, and a time control sub-circuit.

The current supply sub-circuit is connected to a scanning signal terminal, a data signal terminal, a light emitting control terminal, a first power voltage terminal, the time control sub-circuit, and the light emitting device, and is configured to receive a data voltage of the data signal terminal and provide a drive current for the light emitting device.

The time control sub-circuit is connected to the scanning signal terminal, a time length signal terminal, a second power voltage terminal, a direct current control signal terminal, and a direct current voltage terminal, and is configured to receive a time length voltage of the time length signal terminal and a direct current voltage input by the direct current voltage terminal and control time length of connection between the current supply sub-circuit and the light emitting device according to the time length voltage and the direct current voltage to control a time length of light emission of the light emitting device.

In an exemplary embodiment, the time control sub-circuit includes a first signal write module and a time length control module.

The first signal write module is connected to the scanning signal terminal, the time length signal terminal, the second power voltage terminal, and the time length control module, and is configured to input the time length voltage of the time length signal terminal to the time length control module under control of the scanning signal terminal.

The time length control module is connected to the direct current control signal terminal, the direct current voltage terminal, and the current supply sub-circuit, and is configured to, under the control of the direct current signal control terminal, receive the direct current voltage of the direct current voltage terminal and control the time length of connection between the current supply sub-circuit and the light emitting device according to the time length voltage and the direct current voltage to control the time length of light emission of the light emitting device.

In an exemplary embodiment, the time length control module includes a voltage input module and a switch module.

The voltage input module is connected to the direct current signal control terminal, the direct current voltage terminal, the first signal write module, and the switch module, and is configured to input the direct current voltage of the direct current voltage terminal to the switch module under the control of the direct current signal control terminal.

The switch module is connected to the first signal write module, the current supply sub-circuit, and the voltage input module, and is configured to receive the time length voltage and control the time length of connection between the current supply sub-circuit and the light emitting device according to the time length voltage and the direct current voltage to control the time length of light emission of the light emitting device.

In an exemplary embodiment, the voltage input module includes at least two voltage input sub-units. The direct current signal control terminal includes at least two direct current signal control sub-terminals. The direct current voltage terminal includes at least two direct current voltage sub-terminals.

Each voltage input sub-unit corresponds to one of the direct current signal control sub-terminals and one of the direct current voltage sub-terminals.

each voltage input sub-unit has a first terminal connected to the direct current signal control sub-terminal corresponding to the voltage input sub-unit, a second terminal connected to the direct current voltage sub-terminal corresponding to the voltage input sub-unit, and a third terminal connected to the switch module.

In an exemplary embodiment, each voltage input sub-unit includes a transistor.

the transistor has a control terminal connected to the direct current signal control sub-terminal, a first electrode connected to the direct current voltage sub-terminal, and a second electrode connected to the switch module.

In an exemplary embodiment, the switch module includes a first transistor and a first capacitor.

the first transistor has a control terminal which is connected to one end of the first capacitor and the first signal write module, and a first electrode and a second electrode which are connected to the current supply sub-circuit.

The other end of the first capacitor is connected to the voltage input module.

In an exemplary embodiment, the first signal write module includes a second transistor and a third transistor.

the second transistor has a control terminal connected to the scanning signal terminal, a first electrode connected to the time length signal terminal, and a second electrode connected to the time length control module.

the third transistor has a control terminal connected to the scanning signal terminal, a first electrode connected to the second power voltage terminal, and a second electrode connected to the time length control module.

In an exemplary embodiment, the current supply sub-circuit includes a second signal write module, a light emitting control module, and a drive module.

The second signal write module is connected to the scanning signal terminal, the data signal terminal, the time control sub-circuit, and the drive module, and is configured to input the data voltage of the data signal terminal to the drive module under the control of the scanning signal terminal.

The light emitting control module is connected to the light emitting control terminal, the first power voltage terminal, the second signal write module, the drive module, the time control sub-circuit, and the light emitting device, and is configured to connect the first power voltage terminal with the drive module and connect the time control sub-circuit with the light emitting device under the control of the light emitting control terminal.

The drive module is connected to the first power voltage terminal, the light emitting control module, and the second signal write module, and is configured to provide the drive current for the light emitting device.

In an exemplary embodiment, the second signal write module includes a fourth transistor and a fifth transistor.

the fourth transistor has a control terminal connected to the scanning signal terminal, a first electrode connected to the data signal terminal, and a second electrode connected to the light emitting control module and the drive module.

the fifth transistor has a control terminal connected to the scanning signal terminal, a first electrode connected to the drive module, and a second electrode connected to the time control sub-circuit and the drive module.

In an exemplary embodiment, the drive module includes a sixth transistor and a second capacitor.

the sixth transistor has a control terminal connected to the second signal write module, a first electrode connected to the second signal write module and the light emitting control module, and a second electrode connected to the time control sub-circuit and the second signal write module.

One end of the second capacitor is connected to the first power voltage terminal, the other end of the second capacitor is connected to the second signal write module and the control terminal of the sixth transistor.

In an exemplary embodiment, the light emitting control module includes a seventh transistor and an eighth transistor.

the seventh transistor has a control terminal connected to the light emitting control terminal, a first electrode connected to the first power voltage terminal, and a second electrode connected to the drive module and the second signal write module.

the eighth transistor has a control terminal connected to the light emitting control terminal, a first electrode connected to the light emitting device, and a second electrode connected to the time control sub-circuit.

In an exemplary embodiment, the pixel circuit further includes a reset module, which is connected to a reset signal terminal, an initial voltage terminal, and the current supply sub-circuit and is configured to input an initial voltage of the initial voltage terminal to the current supply sub-circuit under control of the reset signal terminal to initialize the current supply sub-circuit.

In an exemplary embodiment, the reset module includes a ninth transistor.

the ninth transistor has a control terminal connected to the reset signal terminal, a first electrode connected to the initial voltage terminal, and a second electrode connected to the current supply sub-circuit.

An embodiment of the present disclosure provides a display substrate, which includes multiple pixel units arranged in an array. Each pixel unit includes the pixel circuit as described in the abovementioned embodiment.

An embodiment of the present disclosure provides a display device, which includes the display substrate as described in the abovementioned embodiment.

An embodiment of the present disclosure provides a method for driving a pixel circuit, which is used for the pixel circuit as described in the abovementioned embodiment and includes the following steps.

Under the control of the scanning signal terminal, the data voltage of the data signal terminal is input to the current supply sub-circuit, and the time length voltage of the time length signal terminal is input to the time control sub-circuit.

Under the control of the direct current signal control terminal and the light emitting control terminal, the direct current voltage input by the direct current voltage terminal is received, and the time length of connection between the current supply sub-circuit and the light emitting device is controlled according to the time length voltage and the direct current voltage, so as to control the time length of light emission of the light emitting device.

In an exemplary embodiment, before the step that the data voltage of the data signal terminal is input to the current supply sub-circuit and the time length voltage of the time length signal terminal is input to the time control sub-circuit under the control of the scanning signal terminal, the following step is further included:

An initial voltage of the initial voltage terminal is input to the current supply sub-circuit under the control of the reset signal terminal to initialize the current supply sub-circuit.

Other aspects may be comprehended upon reading and understanding of the drawings and the detailed descriptions.

BRIEF DESCRIPTION OF DRAWINGS

The abovementioned and/or additional aspects and advantages of the embodiments of the present disclosure will become clear and easy to understand from the following descriptions made to the embodiments in combination with the drawings.

DETAILED DESCRIPTION

Figure 1:
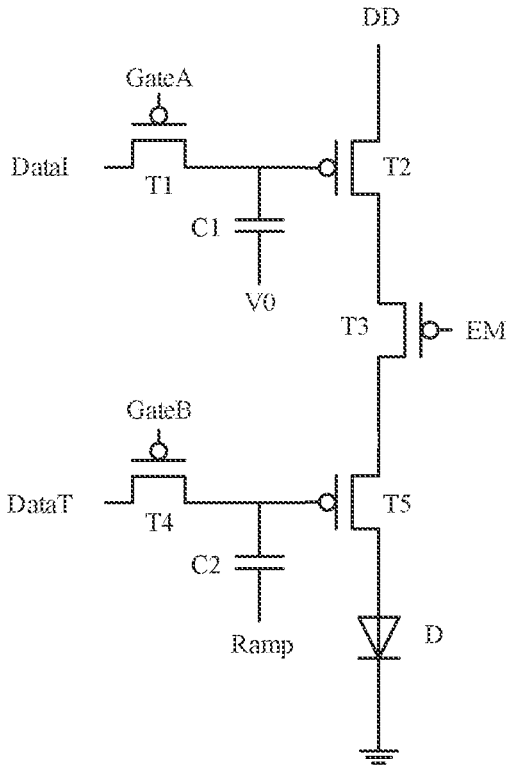
FIG. 1 is a circuit diagram of a full-screen timing pixel circuit.

The present disclosure will be described below in detail. Examples of the embodiments of the present disclosure are illustrated in the drawings throughout which same or similar reference signs represent the same or similar components or components with the same or similar functions. In addition, detailed descriptions about a known technology are omitted if unnecessary to the illustrated features of the present disclosure. The embodiments described below with reference to the drawings are exemplary and are only for explaining the present disclosure and cannot be construed as limitations on the present disclosure.

It can be understood by those skilled in the art that unless otherwise defined, all terms (including technical terms and scientific terms) used herein have the same meanings as commonly understood by those of ordinary skill in the art that the present disclosure belongs to. It should also be understood that terms defined in, for example, a general dictionary, should be understood to have the same meanings as those in the context of the conventional art, and may not be explained as idealized or too formal meanings, unless specifically defined like here.

It can be understood by those skilled in the art that unless otherwise specified, the singular forms "one", "a/an", "said", and "the" used herein may also include plural forms. It should further be understood that wording "include" used in the specification of the present disclosure refers to existence of the feature, integer, step, operation, element, and/or component, but does not exclude the existence or addition of one or more other features, integers, steps, operations, elements, components, and/or combinations thereof. It should be understood that an element referred to as being "connected" to another element may be connected to another element directly or through an intermediate element. In addition, "connection" used herein may include wireless connection. Expression "and/or" used herein includes all or any one and all combinations of one or more listed items that are associated.

Figure 2:
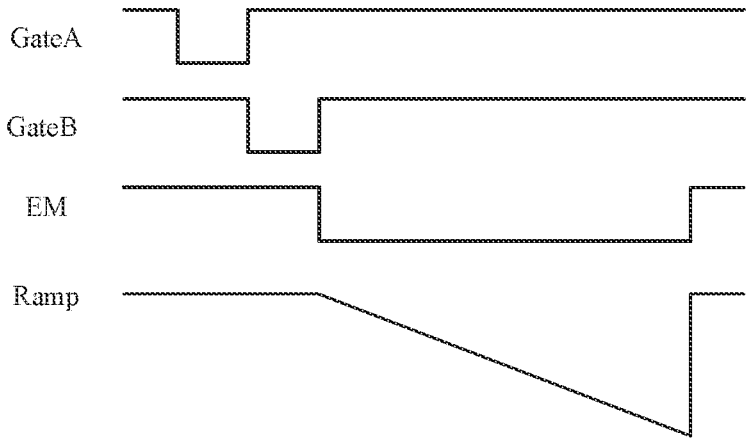
FIG. 2 is a timing diagram of the pixel circuit in FIG. 1.

In the micro inorganic light emitting diode technology, as shown in FIG. 1 and FIG. 2, FIG. 1 illustrates a pixel circuit driving a current-type light emitting element and FIG. 2 illustrates a timing diagram of the pixel circuit shown in FIG. 1, wherein the current-type light emitting element includes an organic light-emitting diode or a micro inorganic light emitting diode.

As shown in FIG. 1, a data voltage VdataI of a data signal terminal DataI controls an operating state of a drive transistor T2, thereby controlling an operating current of the micro inorganic light emitting diode D. When a transistor T4 is turned on (GateB is at low level), a time length voltage VdataT of a time length signal terminal DataT is written to one end of a capacitor C2, and a voltage Vramp of a voltage terminal Ramp is written to the other end of the capacitor. Vramp is a time-varying voltage signal. For example, as shown in FIG. 2, a gate voltage of a transistor T5 decrease accordingly when Vramp decreases, and when a turn-on condition of the transistor T5 is reached, the transistor T5 is turned on, and the micro inorganic light emitting diode emits light. Therefore, different VdataT corresponds to different on periods, and the current-type light emitting element provides different luminance.

As shown in FIG. 2, in a display panel having multiple pixels arranged in an array, voltage terminals Ramp in pixel circuits used to drive each pixel are connected together, namely all the pixels receive a unified Vramp signal. Data signal terminals VdataI of pixel circuits of the same column are connected together, and time length signal terminals DataT of pixel circuits of the same column are connected together. At first, Data voltages VdataI and time length voltages VdataT are sequentially input to pixel circuits of each row. Then, light emitting control signals (EM) output by light emitting control terminals (EM) in all the pixel circuits are turned to active level signals. Meanwhile, the voltage Vramp provided by the voltage terminal Ramp also starts changing with time, namely all the pixels simultaneously emit light.

It is found by the inventor that one of the problems of the abovementioned drive method is its non-correspondence to a high-resolution display panel. Since write time of the data voltage VdataI and the time length voltage VdataT is 2H, wherein 1H refers to time for writing a data voltage or time length voltage to the pixels for one row and its numerical value ranges from several microseconds to dozens of microseconds, and the total write time is obtained by multiplying 1H with the number of rows of pixel units, it takes several milliseconds to ten milliseconds only to write the data voltage VdataI and the time length voltage VdataT, and there is no much time left for light emission of the micro inorganic light emitting diode. Therefore, the pixel circuit and driving timing thereof shown in FIGS. 1 and 2 may correspond to a low-resolution product only.

In view of this, the embodiments of the present disclosure provide a novel pixel circuit and a method for driving the same. A mature display driving solution of a micro inorganic light emitting diode is provided, which may correspond to a high-resolution product.

The technical solutions of the present disclosure will now be described in detail with exemplary embodiments.

An embodiment of the present disclosure provides a pixel circuit, which includes a light emitting device, a current supply sub-circuit, and a time control sub-circuit.

The current supply sub-circuit is connected to a scanning signal terminal, a data signal terminal, a light emitting control terminal, a first power voltage terminal, the time control sub-circuit, and the light emitting device, and is configured to receive a data voltage of the data signal terminal and provide a drive current for the light emitting device.

The time control sub-circuit is connected to the scanning signal terminal, a time length signal terminal, a second power voltage terminal, a direct current control signal terminal, and a direct current voltage terminal, and is configured to receive a time length voltage of the time length signal terminal and a direct current voltage input by the direct current voltage terminal and control time length of connection between the current supply sub-circuit and the light emitting device according to the time length voltage and the direct current voltage to control time length of light emission of the light emitting device.

Since the pixel circuit provided in the embodiment of the present disclosure includes the current supply sub-circuit and the time control sub-circuit, in the embodiment of the present disclosure, the light emitting device may be controlled by the current supply sub-circuit to always operate in a high-current-density region, namely operating in a region where the device is stable in efficiency. Since the time control sub-circuit may control the time length of connection between the current supply sub-circuit and the light emitting device to control time length of light emission of the light emitting device, in the embodiment of the present disclosure, gray-scale display of the light emitting device may be implemented by combination of current control method and time length control method. In the embodiment of the present disclosure, different time lengths of light emission correspond to different gray-scales of the light emitting device.

Optionally, the light emitting device in the embodiment of the present disclosure is a micro inorganic light emitting diode. Since in the pixel circuit in the embodiment of the present disclosure, by the current supply sub-circuit, the light emitting device may be controlled to always operate in the high-current-density region and gray-scale display of the light emitting device is implemented by combination of the current control method and time length control method, the pixel circuit in the embodiment of the present disclosure effectively avoids the problem that the light emitting efficiency of the micro inorganic light emitting diode changes with the current density under a low current density and a color coordinate also changes with the current density.

Figure 3:
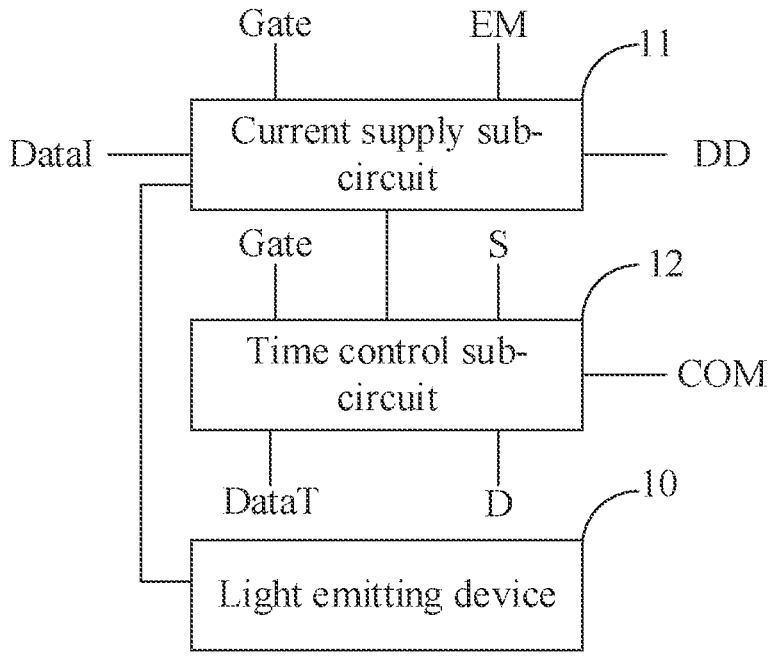
FIG. 3 is a block diagram of a pixel circuit according to an embodiment of the present disclosure.

As shown in FIG. 3, a pixel circuit provided in an embodiment of the present disclosure includes a light emitting device 10, a current supply sub-circuit 11, and a time control sub-circuit 12.

The current supply sub-circuit 11 is connected to a scanning signal terminal (Gate), a data signal terminal (DataI), a light emitting control terminal (EM), a first power voltage terminal (DD), the time control sub-circuit 12, and the light emitting device 10, and is configured to receive a data voltage VdataI of the data signal terminal (DataI) and provide a drive current for the light emitting device 10.

The time control sub-circuit 12 is connected to the scanning signal terminal (Gate), a time length signal terminal (DataT), a second power voltage terminal (COM), a direct current control signal terminal (S), and a direct current voltage terminal (D), and is configured to receive a time length voltage VdataT of the time length signal terminal (DataT) and a direct current voltage input by the direct current voltage terminal (D) and control time length of connection between the current supply sub-circuit 11 and the light emitting device 10 according to the time length voltage VdataT and the direct current voltage (namely controlling time length during which the current supply sub-circuit 11 and the light emitting device 10 are connected and turned on) to control time length of light emission of the light emitting device 10.

Since the pixel circuit provided in the embodiment of the present disclosure includes the current supply sub-circuit 11 and the time control sub-circuit 12, in the embodiment of the present disclosure, the light emitting device 10 may be controlled by the current supply sub-circuit 11 to always operate in a high-current-density region, namely operating in a region where the device is stable in efficiency. Since the time control sub-circuit 12 may control the time length of connection between the current supply sub-circuit 11 and the light emitting device 10 to control the time length of light emission of the light emitting device 10, in the embodiment of the present disclosure, gray-scale display of the light emitting device 10 may be implemented by combination of current control method by time length control method. In the embodiment of the present disclosure, different time lengths of light emission correspond to different gray-scales of the light emitting device.

Figure 4:
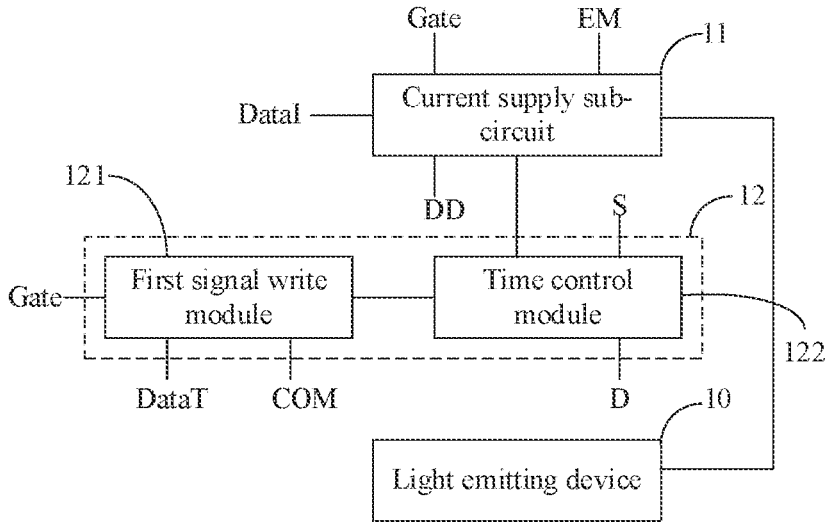
FIGS. 4 to 6 are specific block diagrams of a pixel circuit according to an embodiment of the present disclosure.

In an exemplary embodiment, as shown in FIG. 4, the time control sub-circuit 12 includes a first signal write module 121 and a time length control module 122.

The first signal write module 121 is connected to the scanning signal terminal (Gate), the time length signal terminal (DataT), the second power voltage terminal (COM), and the time length control module 122, and is configured to input the time length voltage VdataT of the time length signal terminal (DataT) to the time length control module 122 under the control of the scanning signal terminal (Gate).

The time length control module 122 is connected to the direct current control signal terminal (S), the direct current voltage terminal (D), and the current supply sub-circuit 11, and is configured to receive the direct current voltage of the direct current voltage terminal (D) and control the time length of connection between the current supply sub-circuit 11 and the light emitting device 10 under the control of the direct current signal control terminal (S) according to the time length voltage VdataT and the direct current voltage to control the time length of light emission of the light emitting device 10.

Figure 5:
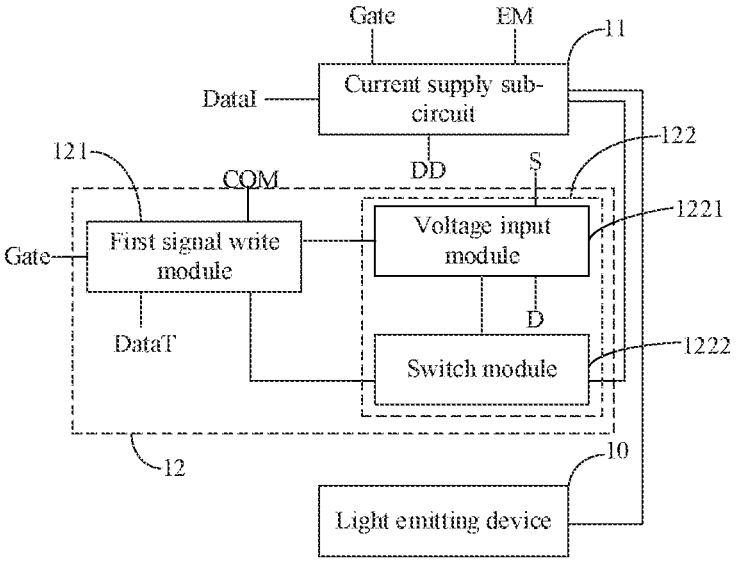

In an exemplary embodiment, as shown in FIG. 5, the time length control module 122 includes a voltage input module 1221 and a switch module 1222.

The voltage input module 1221 is connected to the direct current signal control terminal (S), the direct current voltage terminal (D), the first signal write module 121, and the switch module 1222, and is configured to input the direct current voltage of the direct current voltage terminal (D) to the switch module 1222 under the control of the direct current signal control terminal (S).

The switch module 1222 is connected to the first signal write module 121, the current supply sub-circuit 11, and the voltage input module 1221, and is configured to receive the time length voltage VdataT and control the time length of connection between the current supply sub-circuit 11 and the light emitting device 10 according to the time length voltage VdataT and the direct current voltage, so as to control the time length of light emission of the light emitting device 10.

Figure 6:
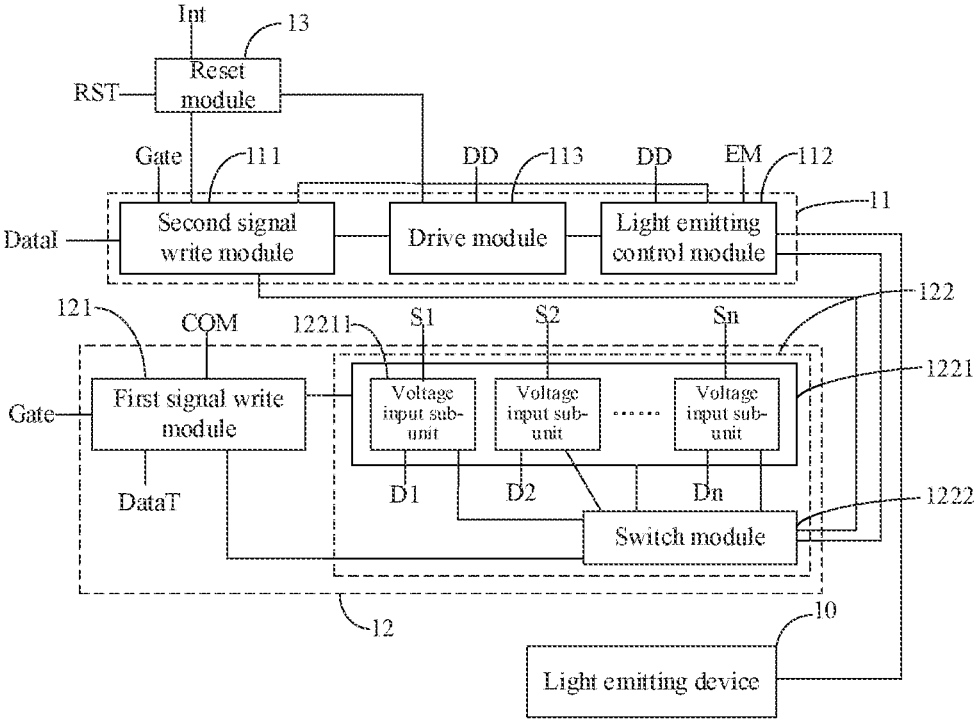

In an exemplary embodiment, as shown in FIG. 6, the voltage input module 1221 includes at least two voltage input sub-units 12211. The direct current signal control terminal (S) includes at least two direct current signal control sub-terminals. FIG. 6 illustrates n direct current signal control sub-terminals (S1, S2 . . . Sn). The direct current voltage terminal (D) includes at least two direct current voltage sub-terminals. FIG. 6 illustrates n direct current voltage sub-terminals (D1, D2 . . . Dn).

Each voltage input sub-unit 12211 corresponds to a direct current signal control sub-terminal and a direct current voltage sub-terminal. Each voltage input sub-unit 12211 has a first terminal connected to the direct current signal control sub-terminal corresponding to the voltage input sub-unit 12211, a second terminal connected to the direct current voltage sub-terminal corresponding to the voltage input sub-unit 12211, and a third terminal connected to the switch module 1222.

In an exemplary embodiment, as shown in FIG. 6, the current supply sub-circuit 11 includes a second signal write module 111, a light emitting control module 112, and a drive module 113.

The second signal write module 111 is connected to the scanning signal terminal (Gate), the data signal terminal (DataI), the time control sub-circuit 12, and the drive module 113, and is configured to input the data voltage VdataI of the data signal terminal (DataI) to the drive module 113 under the control of the scanning signal terminal (Gate).

The light emitting control module 112 is connected to the light emitting control terminal (EM), the first power voltage terminal (DD), the second signal write module 111, the drive module 113, the time control sub-circuit 12, and the light emitting device 10, and is configured to connect the first power voltage terminal (DD) with the drive module 113 and connect the time control sub-circuit 12 with the light emitting device 10 under the control of the light emitting control terminal (EM).

The drive module 113 is connected to the first power voltage terminal (DD), the light emitting control module 112, and the second signal write module 111, and is configured to provide the drive current for the light emitting device 10.

In an exemplary embodiment, as shown in FIG. 6, the pixel circuit of the embodiment of the present disclosure may further include a reset module 13 connected to a reset signal terminal (RST), an initial voltage terminal (Int), and the current supply sub-circuit 11 and the reset module is configured to input an initial voltage Vint of the initial voltage terminal (Int) to the current supply sub-circuit 11 under the control of the reset signal terminal (RST) to initialize the current supply sub-circuit 11.

An initialization stage is a time period between adjacent image frames. The time period is used to eliminate a residual image of a previous image. Any image frame may be scanned row by row from gate lines of the first row to gate lines of the last row. Therefore, the initialization stage occurs after gate lines of the last row of the previous image frame are scanned and pixels of the last row are displayed and before scanning of gate lines of the first row of a next image frame is started.

Figure 7:
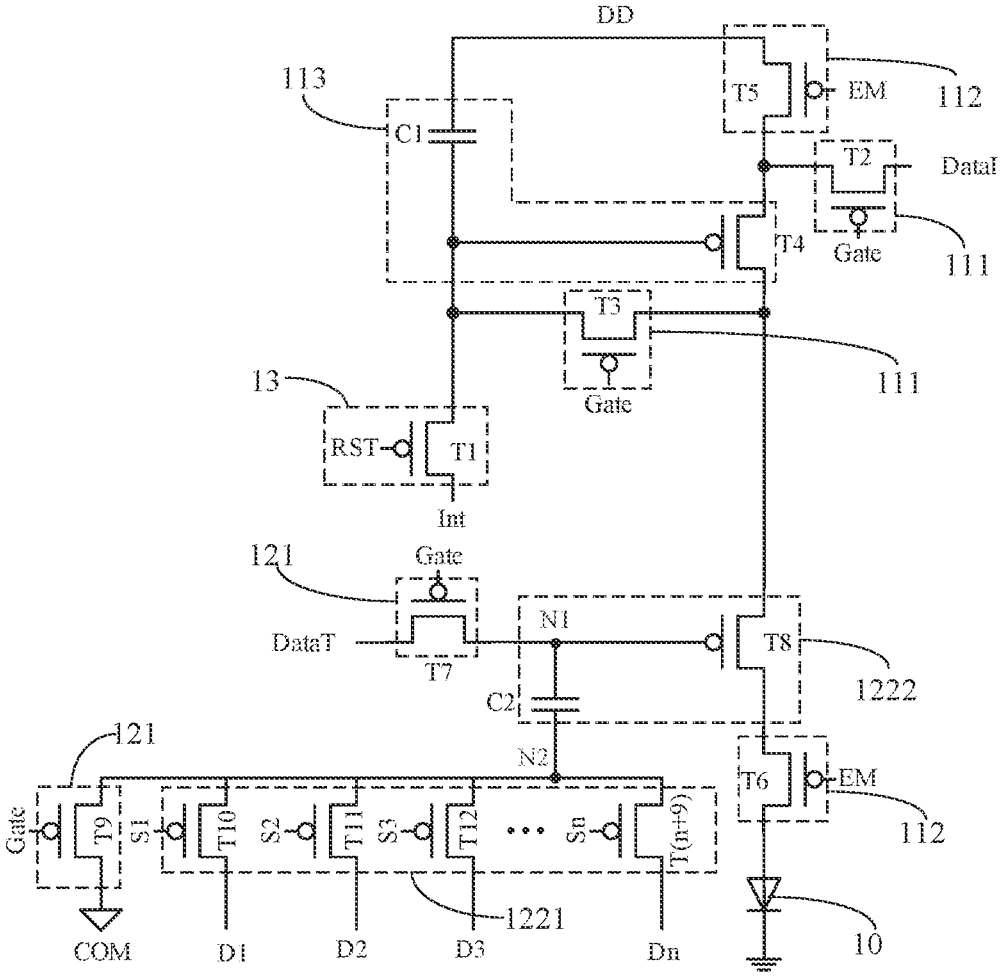
FIG. 7 is a circuit diagram of a pixel circuit according to an embodiment of the present disclosure.
Figure 8:
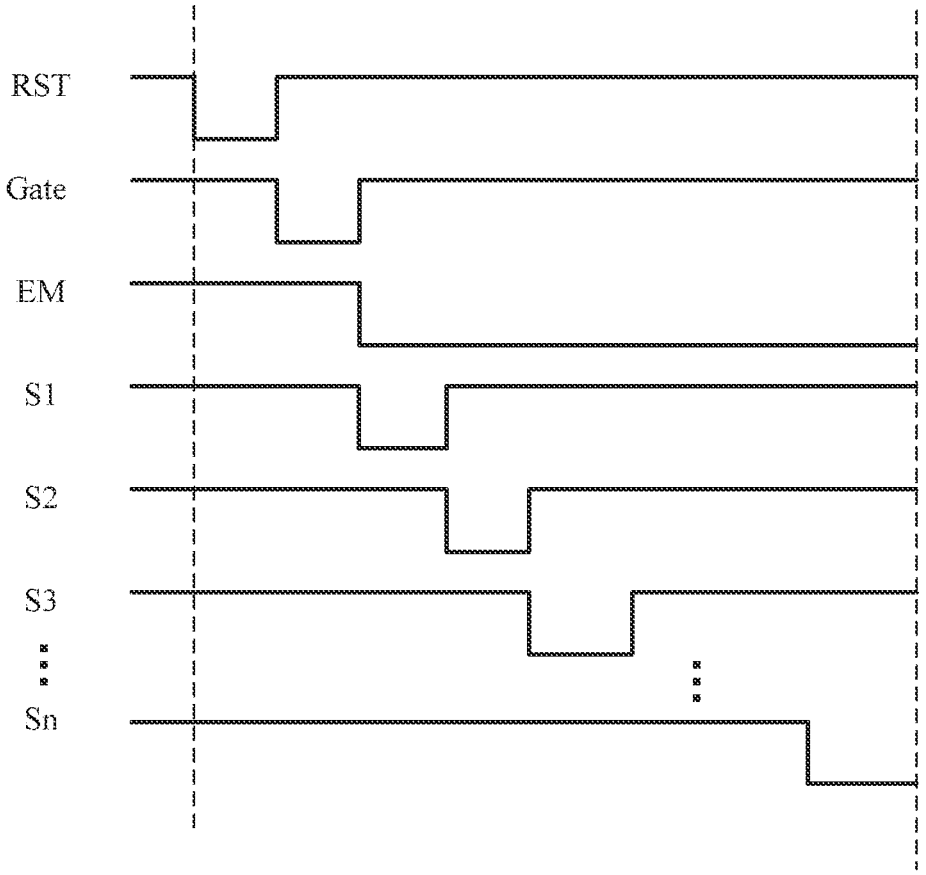
FIG. 8 is a timing diagram of the pixel circuit in FIG. 7.

In an exemplary embodiment, as shown in FIG. 7, a pixel circuit provided in an embodiment of the present disclosure includes a second signal write module 111, a light emitting control module 112, a drive module 113, a reset module 13, a first signal write module 121, a voltage input module 1221, and a switch module 1222. FIG. 8 is a timing diagram of the pixel circuit shown in FIG. 7.

In an exemplary embodiment, as shown in FIG. 7, the voltage input module 1221 includes at least two voltage input sub-units. Each voltage input sub-unit includes a transistor. As shown in FIG. 7, the voltage input module 1221 includes n voltage input sub-units, wherein a first voltage input sub-unit includes a transistor T10, a second voltage input sub-unit includes a transistor T11, a third voltage input sub-unit includes a transistor T12, and an n-th voltage input sub-unit includes a transistor T(n+9). Each voltage input sub-unit corresponds to a direct current signal control sub-terminal and a direct current voltage sub-terminal. As shown in FIG. 7, the first voltage input sub-unit corresponds to a direct current signal control sub-terminal (S1) and a direct current voltage sub-terminal (D1), the second voltage input sub-unit corresponds to a direct current signal control sub-terminal (S2) and a direct current voltage sub-terminal (D2), the third voltage input sub-unit corresponds to a direct current signal control sub-terminal (S3) and a direct current voltage sub-terminal (D3), and the n-th voltage input sub-unit corresponds to a direct current signal control sub-terminal (Sn) and a direct current voltage sub-terminal (Dn). As shown in FIG. 7, the transistor T10 has a control terminal connected to the direct current signal control sub-terminal (S1), a first electrode connected to the direct current voltage sub-terminal (D1), and a second electrode connected to the switch module 1222. The transistor T11 has a control terminal connected to the direct current signal control sub-terminal (S2), a first electrode connected to a direct current voltage sub-terminal (D2), and a second electrode connected to the switch module 1222. The transistor T12 has a control terminal connected to the direct current signal control sub-terminal (S3), a first electrode connected to a direct current voltage sub-terminal (D3), and a second electrode connected to the switch module 1222. The transistor T(n+9) has a control terminal connected to the direct current signal control sub-terminal (Sn), a first electrode connected to a direct current voltage sub-terminal (Dn), and a second electrode connected to the switch module 1222.

In an exemplary embodiment, as shown in FIG. 7, the switch module 1222 includes a first transistor T8 and a first capacitor C2. The first transistor T8 has a control terminal connected to one end of the first capacitor C2 and the first signal write module 121, and a first electrode and a second electrode which are connected to the current supply sub-circuit. The second electrode is connected to the second signal write module 111 of the current supply sub-circuit and the drive module 113. The first electrode is connected to the light emitting control module 112 of the current supply sub-circuit. The other end of the first capacitor C2 is connected to the voltage input module 1221.

In an exemplary embodiment, as shown in FIG. 7, the first signal write module 121 includes a second transistor T7 and a third transistor T9. The second transistor T7 has a control terminal connected to the scanning signal terminal (Gate), a first electrode connected to the time length signal terminal (DataT), and a second electrode connected to the switch module 1222 of the time length control module 122. The third transistor T9 has a control terminal connected to the scanning signal terminal (Gate), a first electrode connected to the second power voltage terminal (COM), and a second electrode connected to the switch module 1222 and the voltage input module 1221 of the time length control module 122.

In an exemplary embodiment, as shown in FIG. 7, the second signal write module 111 includes a fourth transistor T2 and a fifth transistor T3. The fourth transistor T2 has a control terminal of is connected to the scanning signal terminal (Gate), a first electrode connected to the data signal terminal (DataI), and a second electrode connected to the light emitting control module 112 and the drive module 113. The fifth transistor T3 has a control terminal connected to the scanning signal terminal (Gate), a first electrode connected to the drive module 113 and a reset module 13 (optional), and a second electrode connected to the switch module 1222 of the time control sub-circuit 12 and the drive module 113.

In an exemplary embodiment, as shown in FIG. 7, the drive module 113 includes a sixth transistor T4 and a second capacitor C1. The sixth transistor T4 has a control terminal connected to the second signal write module 111 and the reset module 13 (optional), a first electrode connected to the second signal write module 111 and the light emitting control module 112, and a second electrode connected to the switch module 1222 of the time control sub-circuit 12 and second signal write module 111. One end of the second capacitor C1 is connected to the first power voltage terminal (DD), while the other end is connected to the second signal write module 111, the reset module 13 (optional), and the control terminal of the sixth transistor T4.

In an exemplary embodiment, as shown in FIG. 7, the light emitting control module 112 includes a seventh transistor T5 and an eighth transistor T6. The seventh transistor T5 has a control terminal connected to the light emitting control terminal (EM), a first electrode connected to the first power voltage terminal (DD), and a second electrode connected to the drive module 113 and the second signal write module 111. The eighth transistor T6 has a control terminal connected to the light emitting control terminal (EM), a first electrode connected to the light emitting device 10, and a second electrode connected to the switch module 1222 of the time control sub-circuit 12.

In an exemplary embodiment, as shown in FIG. 7, the reset module 13 includes a ninth transistor T1. The ninth transistor T1 has a control terminal connected to the reset signal terminal (RST), a first electrode connected to the initial voltage terminal (Int), and a second electrode connected to the drive module 113 and second signal write module 111 of the current supply sub-circuit 11.

Optionally, the light emitting device 10 in the embodiment of the present disclosure may be a micro inorganic light emitting diode.

Optionally, as shown in FIG. 7, the first transistor T8, second transistor T7, third transistor T9, fourth transistor T2, fifth transistor T3, sixth transistor T4, seventh transistor T5, eighth transistor T6, ninth transistor T1, transistor T10, transistor T11, transistor T12, and transistor T(n+9) in the embodiment of the present disclosure are all P-type transistors. Of course, these transistors may also be N-type transistors in practical circuit design. Types of the transistors are not limited in the embodiment of the present disclosure. The first electrodes of these transistors may be sources, while the second electrodes of these transistors may be drains. Of course, the first electrodes may also be the drains, and the second electrodes may also be the sources. In practical design, the first electrodes and second electrodes of these transistors are interchangeable.

The pixel circuit of the embodiment of the present disclosure will now be described in detail with an example.

Figure 9:
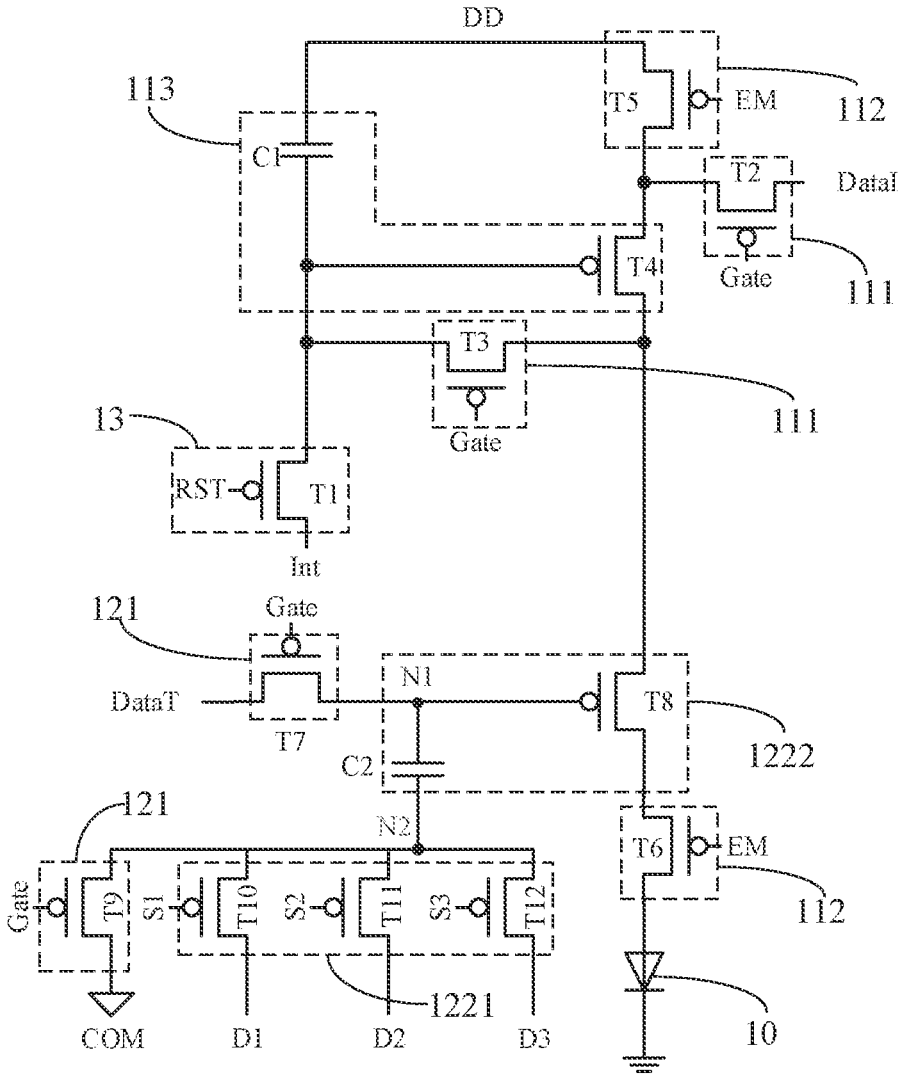
FIG. 9 is a circuit diagram of another pixel circuit according to an example of the present disclosure.

As shown in FIG. 9, a pixel circuit provided in an embodiment of the present disclosure includes a scanning signal terminal (Gate), a light emitting control terminal (EM), a data signal terminal (DataI), a time length signal terminal (DataT), a first power voltage terminal (DD), a second power voltage terminal (COM), direct current signal control terminals (S1, S2, and S3), direct current voltage terminals (D1, D2, and D3), a reset signal terminal (RST), an initial voltage terminal (Int), a first capacitor C2, a second capacitor C1, a first transistor T8, a second transistor T7, a third transistor T9, a fourth transistor T2, a fifth transistor T3, a sixth transistor T4, a seventh transistor T5, an eighth transistor T6, a ninth transistor T1, a transistor T10, a transistor T11, and a transistor T12.

Optionally, as shown in FIG. 9, the first transistor T8 has a control terminal which is connected to a first terminal of the first capacitor C2 and a second electrode of the second transistor T7, a first electrode connected to a second electrode of the eighth transistor T6, and a second electrode which is connected to a second electrode of the fifth transistor T3 and a second electrode of the sixth transistor T4.

The second transistor T7 has a control terminal connected to the scanning signal terminal (Gate), a first electrode connected to the time length signal terminal (DataT), and a second electrode which is connected to the control terminal of the first transistor T8 and the first terminal of the first capacitor C2.

The third transistor T9 has a control terminal connected to the scanning signal terminal (Gate), a first electrode connected to the second power voltage terminal (COM), and a second electrode connected to a second terminal of the first capacitor C2.

The fourth transistor T2 has a control terminal connected to the scanning signal terminal (Gate), a first electrode connected to the data signal terminal (DataI), and a second electrode which is connected to a second electrode of the seventh transistor T5 and a first electrode of the sixth transistor T4.

The fifth transistor T3 has a control terminal connected to the scanning signal terminal (Gate), a first electrode which is connected to a control terminal of the sixth transistor T4, a second terminal of the second capacitor C1 and a second electrode of the ninth transistor T1, and a second electrode which is connected to the second electrode of the first transistor T8 and the second electrode of the sixth transistor T4.

The sixth transistor T4 has the control terminal which is connected to the second terminal of the second capacitor C1, the second electrode the ninth transistor T1, and the first electrode of the fifth transistor T3, a first electrode which is connected to the second electrode of the fourth transistor T2 and the second electrode of the seventh transistor T5, and a second electrode which is connected to the second electrode of the fifth transistor T3 and the second electrode of the first transistor T8.

The seventh transistor T5 has a control terminal connected to the light emitting control terminal (EM), a first electrode connected to the first power voltage terminal (DD), and a second electrode which is connected to the second electrode of the fourth transistor T2 and the first electrode of the sixth transistor T4.

The eighth transistor T6 has a control terminal connected to the light emitting control terminal (EM), a first electrode connected to the light emitting device 10, and the second electrode connected to the first electrode of the first transistor T8.

The ninth transistor T1 has a control terminal connected to the reset signal terminal (RST), a first electrode connected to the initial voltage terminal (Int), and the second electrode which is connected to the second terminal of the second capacitor C1, the control terminal of the sixth transistor T4, and the first electrode of the fifth transistor T3.

The transistor T10 has a control terminal connected to the direct current signal control sub-terminal (S1), a first electrode connected to the direct current voltage sub-terminal (D1), and a second electrode connected to the second terminal of the first capacitor C2. The transistor T11 has a control terminal connected to the direct current signal control sub-terminal (S2), a first electrode connected to the direct current voltage sub-terminal (D2), and a second electrode connected to the second terminal of the first capacitor C2. The transistor T12 has a control terminal connected to the direct current signal control sub-terminal (S3), a first electrode connected to the direct current voltage sub-terminal (D3), and a second electrode connected to the second terminal of the first capacitor C2.

Figure 10:
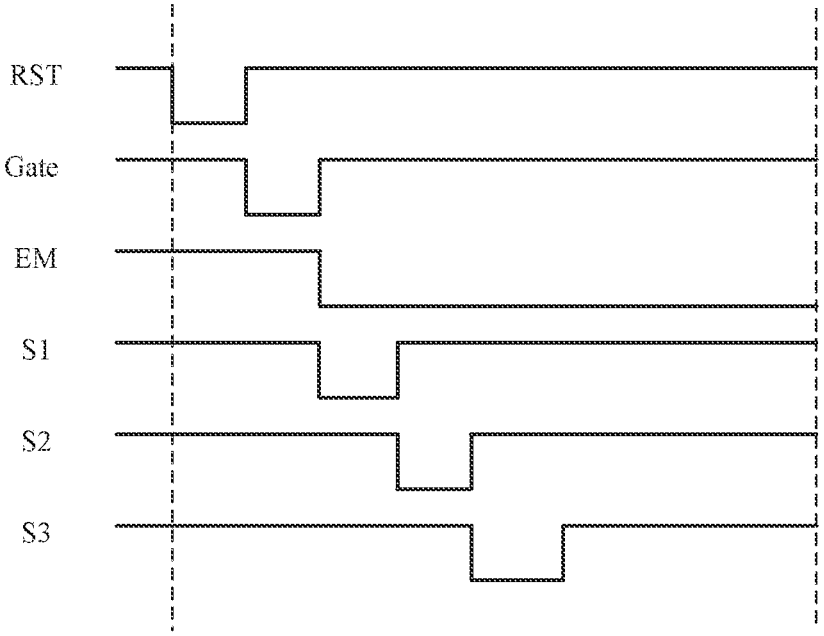
FIG. 10 is a timing diagram of the pixel circuit in FIG. 9.
Figure 11:
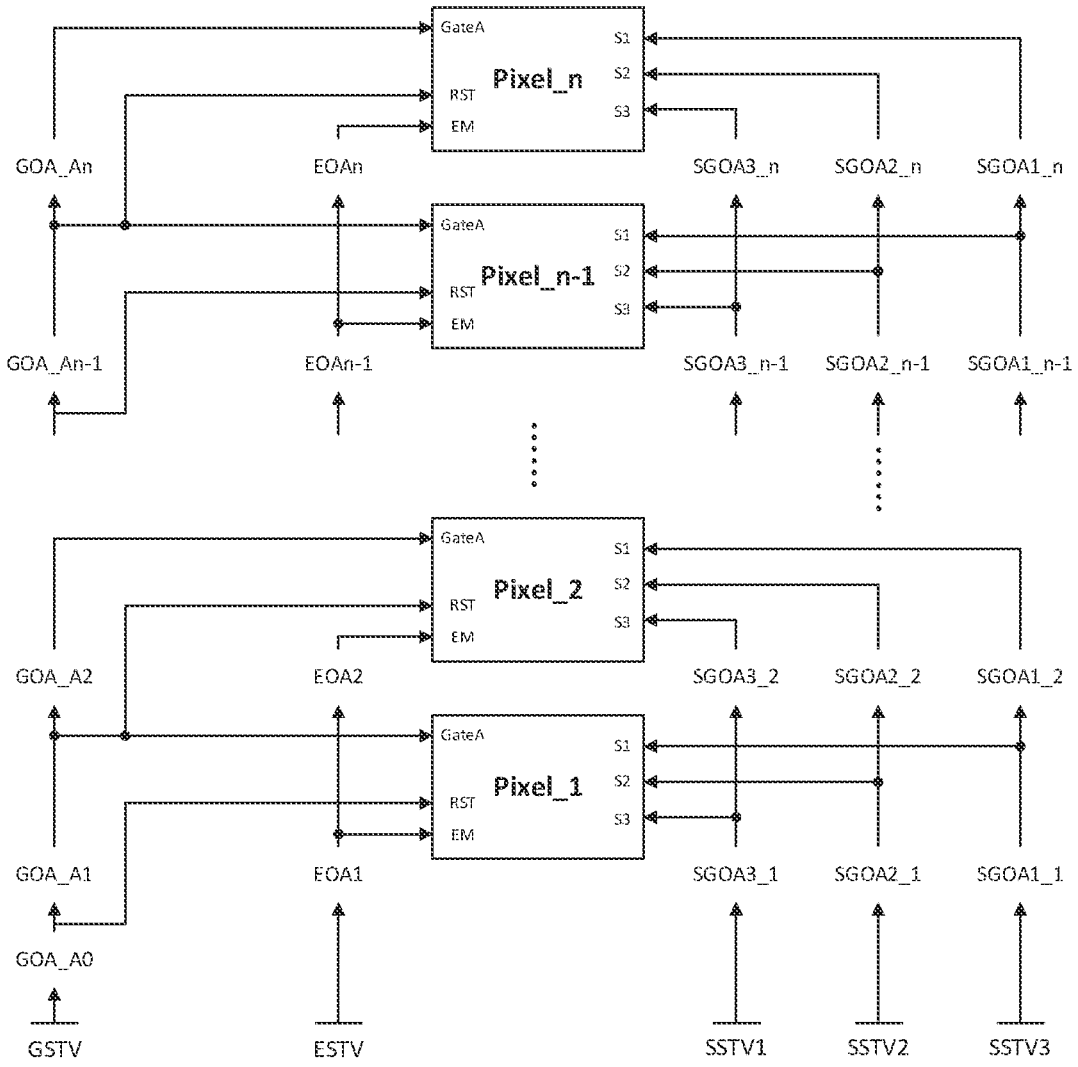
FIG. 11 is a diagram of a Gate On Array (GOA) circuit providing a timing signal in FIG. 10.

FIG. 10 is a timing diagram of the pixel circuit shown in FIG. 9. A timing signal in FIG. 10 may be provided by a GOA circuit shown in FIG. 11. As shown in FIG. 11, the GOA circuit includes multiple stages of cascaded shift registers. Signals GSTV, ESTV, SSTV1, SSTV2, and SSTV3 are input signals of the GOA circuit. An output signal corresponding to signal GSTV is a signal of a scanning signal terminal (Gate). An output end corresponding to signal ESTV is a signal of a light emitting control terminal (EM). An output signal corresponding to signal SSTV1 is a signal of a direct current signal control sub-terminal S3. An output signal corresponding to signal SSTV2 is a signal of a direct current signal control sub-terminal S2. An output end corresponding to signal SSTV3 is a signal of a direct current signal control sub-terminal S1. An operating process of the GOA circuit will not be described repeatedly here.

An operating process of the pixel circuit provided in the embodiment of the present disclosure will be introduced below in combination with the drawings.

The operating process of the pixel circuit provided in the embodiment of the present disclosure includes a reset stage, a data write stage, and a light emitting stage. The light emitting device 10 in the present embodiment is a micro inorganic light emitting diode.

Figure 12:
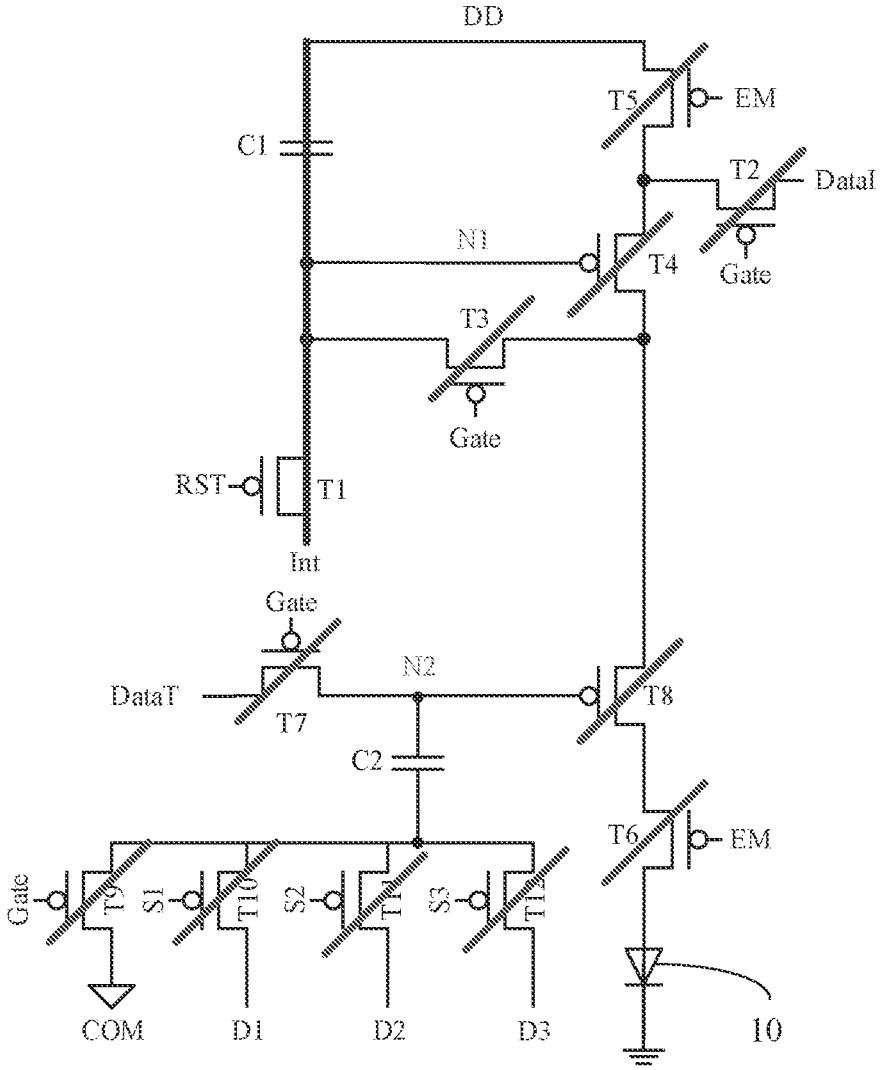
FIG. 12 is a circuit diagram of a pixel circuit in a reset stage according to an embodiment of the present disclosure.

As shown in FIG. 10, in the reset stage, the reset signal terminal (RST) outputs a low-level signal, and all the scanning signal terminal (Gate), the light emitting control terminal (EM), the direct current signal control sub-terminal (S1), the direct current signal control sub-terminal (S2), and the direct current signal control sub-terminal (S3) output high-level signals. In such case, as shown in FIG. 12, only the ninth transistor T1 is on, and all the other transistors are in an off state. Potentials of two plates of the second capacitor C1 are initialized by an initial voltage Vint of an initial voltage terminal (Int) connected to the first electrode and a power voltage VDD of a first power voltage terminal (DD). Initialization may make the pixel circuit in a determined initial state.

Figure 13:
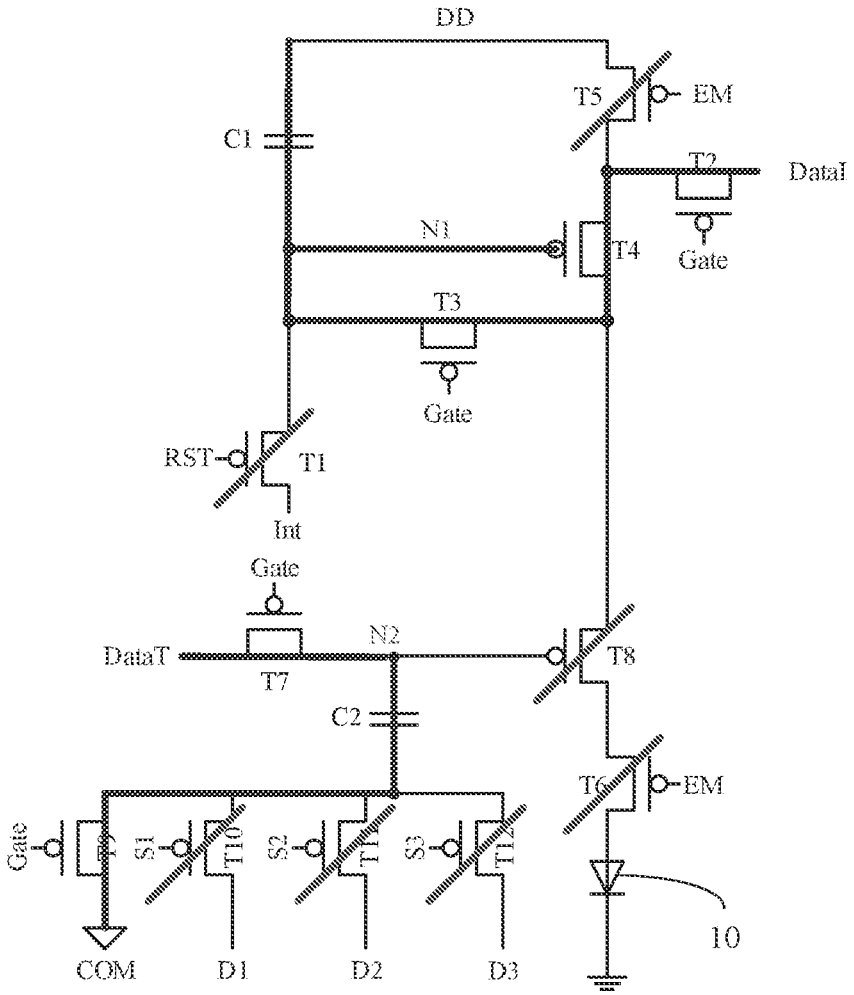
FIG. 13 is a circuit diagram of a pixel circuit in a data write stage according to an embodiment of the present disclosure.

As shown in FIG. 10, in the data write stage, the scanning signal terminal (Gate) outputs a low-level signal, and all the reset signal terminal (RST), the light emitting control terminal (EM), the direct current signal control sub-terminal (S1), the direct current signal control sub-terminal (S2), and the direct current signal control sub-terminal (S3) output high-level signals. As shown in FIG. 13, the fourth transistor T2, the fifth transistor T3, the sixth transistor T4, the second transistor T7, and the third transistor T9 are on, and all the other transistors are in the off state. A data voltage VdataI of a data signal terminal (DataI) is written, and a voltage at point N1 is VdataI+threshold voltage Vth of the sixth transistor T4. Moreover, a time length voltage VdataT of a time length signal terminal (DataT) is written, and a voltage at point N2 is VdataT. The time length voltage VdataT is stored in the first capacitor C2.

As shown in FIG. 10, in the light emitting stage, the light emitting stage of the pixel circuit provided in the present embodiment includes three stages. In a first light emitting stage, the light emitting control terminal (EM) and the direct current signal control sub-terminal (S1) output low-level signals, and all the scanning signal terminal (Gate), the reset signal terminal (RST), the direct current signal control sub-terminal (S2), and the direct current signal control sub-terminal (S3) output high-level signals. In a second light emitting stage, the light emitting control terminal (EM) and the direct current signal control sub-terminal (S2) output low-level signals, and all the scanning signal terminal (Gate), the reset signal terminal (RST), the direct current signal control sub-terminal (S1), and the direct current signal control sub-terminal (S3) output high-level signals, In a third light emitting stage, the light emitting control terminal (EM) and the direct current signal control sub-terminal (S3) output low-level signals, and all the scanning signal terminal (Gate), the reset signal terminal (RST), the direct current signal control sub-terminal (S1), and the direct current signal control sub-terminal (S2) output high-level signals.

Figure 14:
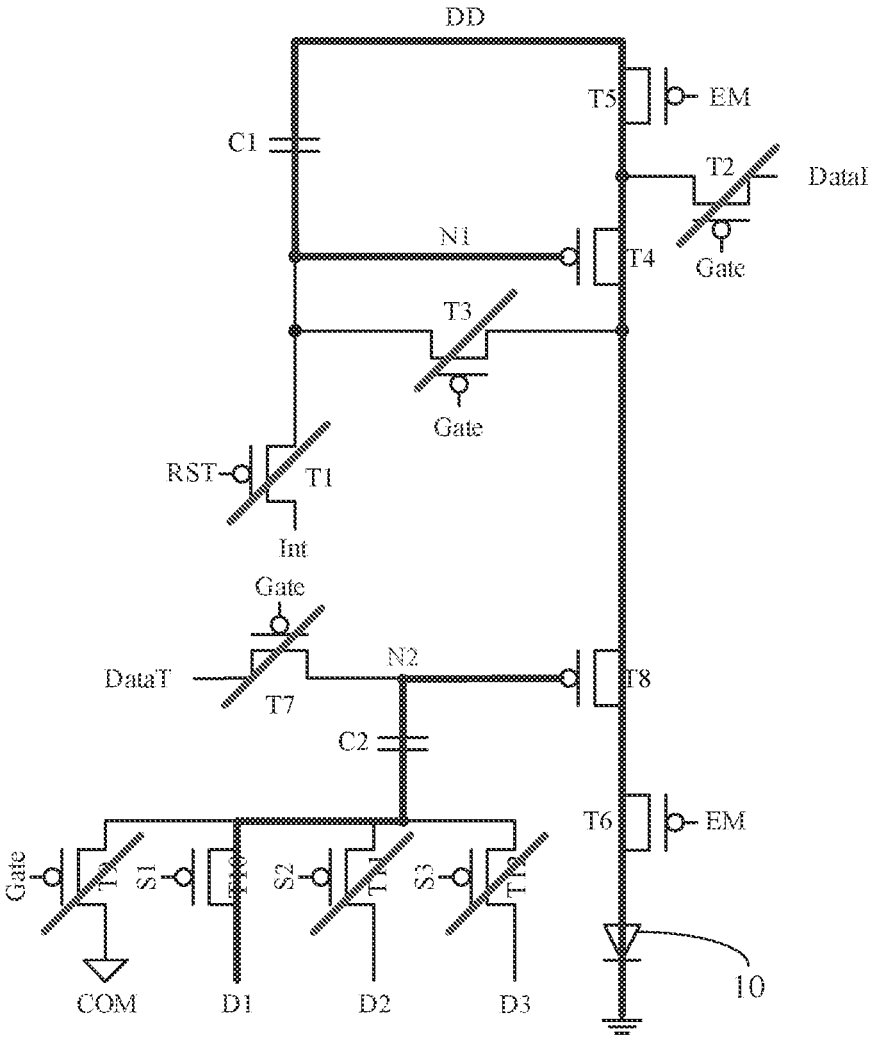
FIG. 14 is a circuit diagram of a pixel circuit in a first light emitting stage according to an embodiment of the present disclosure.

In the first light emitting stage, as shown in FIG. 14, the sixth transistor T4, the seventh transistor T5, the eighth transistor T6, and the transistor T10 are on, the state of the first transistor T8 is undetermined, and all the other transistors are in the off state. In a current control part, the sixth transistor T4 generates an operating current $I_{DS}$ of the micro inorganic light emitting diode:

$$I_{DS} = \frac{1}{2}\mu C_{ox}\frac{W}{L}(V_{GS} - Vth)^2 = \frac{1}{2}\mu C_{ox}\frac{W}{L}(Vdata + Vth - VDD - Vth)^2 = \frac{1}{2}\mu C_{ox}\frac{W}{L}(VdataI - VDD)^2.$$

Herein, μ denotes the mobility of the material of the sixth transistor T4, Cox denotes a capacitance value of the sixth transistor T4, W denotes a width of the sixth transistor T4, and L denotes a length of the sixth transistor T4. Therefore, in the first light emitting stage in the present embodiment, the operating current $I_{DS}$ of the micro inorganic light emitting diode is unrelated to the threshold voltage Vth of the sixth transistor T4, and may not affect the light emission of the micro inorganic light emitting diode. In a time control part, since the transistor T10 is on, the second terminal of the first capacitor C2 is connected to a direct current voltage sub-terminal (D1), and the voltage at point N2 is bootstrapped to VdataT+V1−VCOM due to the bootstrapping action of the first capacitor C2. If the voltage VdataT+V1−VCOM at point N2 makes the first transistor T8 satisfy a turn-on condition $V_{GS} \geq Vth8$, Vth8 is a threshold voltage of the first transistor T8, the first transistor T8 is turned on, and the micro inorganic light emitting diode starts to emit light. If the voltage VdataT+V1−VCOM at point N2 may not satisfy the turn-on condition of the first transistor T8, the micro inorganic light emitting diode does not emit light in a time period when the direct current signal control sub-terminal (S1) outputs a low-level signal.

Figure 15:
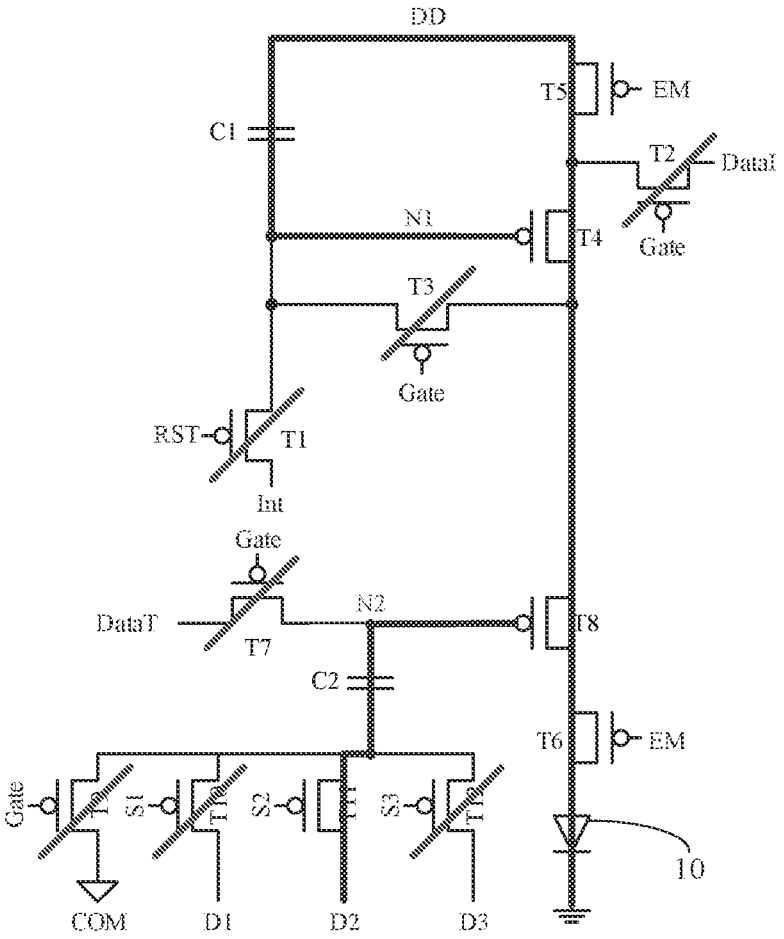
FIG. 15 is a circuit diagram of a pixel circuit in a second light emitting stage according to an embodiment of the present disclosure.

In the second light emitting stage, as shown in FIG. 15, the sixth transistor T4, the seventh transistor T5, the eighth transistor T6, and the transistor T11 are on, the state of the first transistor T8 is undetermined, and all the other transistors are in the off state. A current control part is the same as that in the first light emitting stage, which will not be described repeatedly here. In a time control part, since the transistor T11 is on, the second terminal of the first capacitor C2 is connected to a direct current voltage sub-terminal (D2), and the voltage at point N2 is bootstrapped to VdataT+V2−VCOM due to the bootstrapping action of the first capacitor C2. If the voltage VdataT+V2−VCOM at point N2 makes the first transistor T8 satisfy the turn-on condition $V_{GS} \geq Vth8$, the first transistor T8 is turned on, and the micro inorganic light emitting diode continues emitting light. If the voltage VdataT+V2−VCOM at point N2 cannot satisfy the turn-on condition of the first transistor T8, the micro inorganic light emitting diode does not emit light in a time period when the direct current signal control sub-terminal (S2) outputs a low-level signal.

Figure 16:
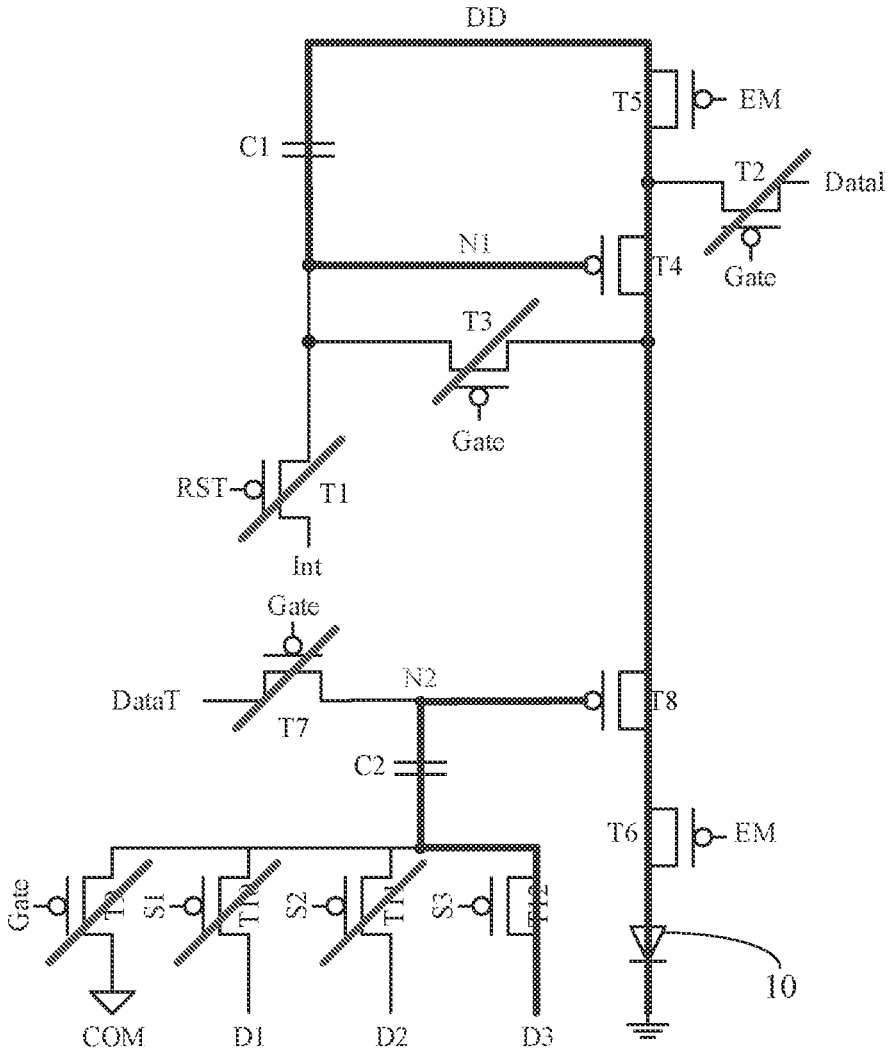
FIG. 16 is a circuit diagram of a pixel circuit in a third light emitting stage according to an embodiment of the present disclosure.

In the third light emitting stage, as shown in FIG. 16, the sixth transistor T4, the seventh transistor T5, the eighth transistor T6, and the transistor T12 are on, the state of the first transistor T8 is undetermined, and all the other transistors are in the off state. A current control part is the same as that in the first light emitting stage, which will not be described repeatedly here. In a time control part, the transistor T12 is on, the second terminal of the first capacitor C2 is connected to a direct current voltage sub-terminal (D3), and the voltage at point N2 is bootstrapped to VdataT+V3−VCOM due to the bootstrapping action of the first capacitor C2. If the voltage VdataT+V3−VCOM at point N2 makes the first transistor T8 satisfy the turn-on condition $V_{GS}$≥Vth8, the first transistor T8 is turned on, and the micro inorganic light emitting diode continues emitting light. If the voltage VdataT+V3−VCOM at point N2 cannot satisfy the turn-on condition of the first transistor T8, the micro inorganic light emitting diode does not emit light in a time period when the direct current signal control sub-terminal (S3) outputs a low-level signal.

According to the embodiment of the present disclosure, the micro inorganic light emitting diode is controlled by the data voltage VdataI to always operate in a high-current-density region, namely operating in a region where the device is stable in efficiency. Then, the transistor T10, the transistor T11, and the transistor T12 are sequentially turned on according to timing, a direct current voltage V1, a direct current V2, and a direct current voltage V3 are input to the second terminal of the first capacitor C2 respectively, and then the first terminal of the second capacitor C2 may be bootstrapped to corresponding voltages, thereby controlling an on state of the first transistor T8 and further controlling the time length of light emission of the micro inorganic light emitting diode, finally gray-scale display of the micro inorganic light emitting diode is implemented by combination of current control method and time length control method. The pixel circuit of the embodiment of the present disclosure remedies the defects of the light emitting device of micro inorganic light emitting diode type.

It can be understood that the direct current voltages V1, V2, and V3 transmitted by the direct current voltage sub-terminals D1, D2, and D3 are voltages of fixed magnitudes. The implementation of different gray-scales of the light emitting device 10 is mainly determined by the time length voltage VdataT provided by the fixed time length signal terminal (DataT).

Manners for implementing different gray-scales of the light emitting device (such as a micro inorganic light emitting diode) in the embodiment of the present disclosure will now be described in combination with FIGS. 10, 14, 15, and 16.

As shown in FIGS. 10 and 14, in the first light emitting stage, when the voltage VdataT+V1−VCOM at point N2 makes the first transistor T8 satisfy the turn-on condition $V_{GS}$≥Vth8, the first transistor T8 is turned on, and the micro inorganic light emitting diode starts emitting light. As shown in FIGS. 10 and 15, in the second light emitting stage, when the voltage VdataT+V2−VCOM at point N2 makes the first transistor T8 satisfy the turn-on condition $V_{GS}$≥Vth8, the first transistor T8 is turned on, and the micro inorganic light emitting diode starts emitting light. As shown in FIGS. 10 and 16, in the third light emitting stage, when the voltage VdataT+V3−VCOM at point N2 makes the first transistor T8 satisfy the turn-on condition $V_{GS}$≥Vth8, the first transistor T8 is turned on, and the micro inorganic light emitting diode starts emitting light. That is, in the embodiment of the present disclosure, the micro inorganic light emitting diode emits light in all the first light emitting stage, the second light emitting stage, and the third light emitting stage. In such case, a brightest gray-scale state of the micro inorganic light emitting diode may be achieved.

Therefore, when the magnitude of the direct current voltage V1 transmitted by the direct current voltage sub-terminal D1 satisfies condition 0≤V1≤(Vs−VdataT+VCOM+Vth8), with Vs being a source voltage of the first transistor T8 and being a fixed value in case of a determined circuit design, and voltage conditions that the direct current voltages V2 and V3 transmitted by the direct current voltage sub-terminals D2 and D3 are required to satisfy are the same as the condition that V1 is required to satisfy, a brightest gray-scale may be achieved.

As shown in FIGS. 10 and 14, in the first light emitting stage, when the voltage VdataT+V1−VCOM at point N2 may not satisfy the turn-on condition $V_{GS}$≥Vth8 of the first transistor T8, the first transistor T8 is turned off, and the micro inorganic light emitting diode does not emit light. As shown in FIGS. 10 and 15, in the second light emitting stage, when the voltage VdataT+V2−VCOM at point N2 may not satisfy the turn-on condition $V_{GS}$≥Vth8 of the first transistor T8, the first transistor T8 is turned off, and the micro inorganic light emitting diode does not emit light. As shown in FIGS. 10 and 16, in the third light emitting stage, when the voltage VdataT+V3−VCOM at point N2 may not satisfy the turn-on condition $V_{GS}$≥Vth8 of the first transistor T8, the first transistor T8 is turned off, and the micro inorganic light emitting diode does not emit light. That is, in the embodiment of the present disclosure, the micro inorganic light emitting diode does not emit light in all the first light emitting stage, the second light emitting stage, and the third light emitting stage. In such case, a darkest gray-scale state of the micro inorganic light emitting diode may be achieved.

Optionally, when the darkest gray-scale state is achieved, the voltage condition that V1 is required to satisfy is that V1 is more than or equal to Vs−VdataT+VCOM+Vth8, and voltage conditions that V2 and V3 are required to satisfy are the same as the condition that V1 is required to satisfy.

As shown in FIGS. 10 and 14, in the first light emitting stage, when the voltage VdataT+V1−VCOM at point N2 makes the first transistor T8 satisfies the turn-on condition $V_{GS}$≥Vth8, the first transistor T8 is turned on, and the micro inorganic light emitting diode starts emitting light. As shown in FIGS. 10 and 15, in the second light emitting stage, when the voltage VdataT+V2−VCOM at point N2 may not satisfy the turn-on condition $V_{GS}$≥Vth8 of the first transistor T8, the first transistor T8 is turned off, and the micro inorganic light emitting diode does not emit light. As shown in FIGS. 10 and 16, in the third light emitting stage, when the voltage VdataT+V3−VCOM at point N2 may not satisfy the turn-on condition $V_{GS}$≥Vth8 of the first transistor T8, the first transistor T8 is turned off, and the micro inorganic light emitting diode does not emit light. That is, in the embodiment of the present disclosure, the micro inorganic light emitting diode emits light in the first light emitting stage, and does not emit light in both the second light emitting stage and the third light emitting stage. In such case, an intermediate gray-scale state of the micro inorganic light emitting diode between the brightest gray-scale state and the darkest gray-scale state may be achieved. Of course, the intermediate gray-scale state of the micro inorganic light emitting diode may also be achieved under the conditions that the micro inorganic light emitting diode emits light in both the first light emitting stage and the second light emitting stage and does not emit light in the third light emitting stage, etc. In the embodiment of the present disclosure, the intermediate gray-scale state of the micro inorganic light emitting diode may be achieved as long as light is emitted not in all the three light emitting stages but in at least one light emitting stage.

Optionally, when the intermediate gray-scale state is achieved (taking the condition that the micro inorganic light emitting diode emits light in the first light emitting stage and does not emit light in both the second light emitting stage and the third light emitting stage as an example), the voltage condition that V1 is required to satisfy is that V1 is more than or equal to 0 and less than or equal to Vs−VdataT+VCOM+Vth8, the voltage condition that V2 is required to satisfy is that V2 is more than or equal to Vs−VdataT+VCOM+Vth8, and the voltage condition that V3 is required to satisfy is the same as that satisfied by V2. In addition, V1, V2, and V3 may be set to unequal magnitudes under the condition that V1, V2, and V3 satisfy the voltage conditions, to implement the intermediate gray-scale state better in the embodiment of the present disclosure. For example, the values of V1, V2, and V3 may be set to increase or decrease sequentially.

As shown in FIG. 10, the time of active levels (i.e., low levels) of the direct current signal control sub-terminal S1, the direct current signal control sub-terminal S2, and the direct current signal control sub-terminal S3 in the embodiment of the present disclosure may be set equal or unequal, and there is no specific relation between the three as long as total time of the active levels of S1, S2, and S3 is less than or equal to [display time per frame of the display panel-(reset time of the pixel units of each row (i.e., time of the active level of the Reset signal)+data write time of the pixel units of each row (i.e., time of the active level of the Gate signal)].

According to the embodiment of the present disclosure, in the display panel having multiple pixels arranged in an array, the data signal terminals DataI of the pixel circuits of the same column are connected together, the time length signal terminals DataT of the pixel circuits of the same column are connected together, the scanning signal terminals Gate of the pixel circuits of the same row are connected together, the light emitting control terminals EM of the pixel circuits of the same row are connected together, the direct current signal control terminals S of the pixel circuits of the same row are connected together, and the reset signal terminals RST of the pixel circuits of the same row are connected together. In the embodiment of the present disclosure, the direct current voltage V1, the direct current voltage V2, and the direct current voltage V3 are direct current signals shared by the whole screen, and the direct current voltage input to the pixel circuit is selected by using the timing of the direct current signal control sub-terminal S1, the direct current signal control sub-terminal S2, and the direct current signal control sub-terminal S3. Since the direct current signal control sub-terminal (S1), the direct current signal control sub-terminal (S2), and the direct current signal control sub-terminal (S3) are provided by the same set of GOA circuit, the pixel circuit provided in the embodiment of the present disclosure may implement row-by-row light emission of the pixels, namely after data voltages VdataI and time length voltages VdataT of pixels of a row are written, the pixels of the row directly emit light. Of course, the pixel circuit provided in the embodiment of the present disclosure may also implement simultaneous light emission of all the pixels, namely all the pixels start emitting light after the data voltages VdataI and time length voltages VdataT of all the pixels are written. When the pixel circuit provided in the embodiment of the present disclosure adopts row-by-row light emission, the write time of the data voltages VdataI and time length voltages VdataT of the pixels of each row is 1H, only more than ten microseconds, and light may be emitted even if the data voltages VdataI and time length voltages VdataT of the whole screen are not completely written. Therefore, the pixel circuit provided in the embodiment of the present disclosure may be applied to a high-resolution product.

Based on the same concept, an embodiment of the present disclosure also provides a display substrate, which includes a plurality of pixel units arranged in an array. Each pixel unit includes the pixel circuit as described in the abovementioned embodiment. Since including the pixel circuit provided in the abovementioned embodiment of the present disclosure, the display substrate provided in the embodiment of the present disclosure have the same beneficial effects as the pixel circuit. Elaborations are omitted herein.

Based on the same concept, an embodiment of the present disclosure also provides a display device, which includes the display substrate as described in the abovementioned embodiment. Since including the display substrate provided in the abovementioned embodiment of the present disclosure, the display device provided in the embodiment of the present disclosure have the same beneficial effects as the display substrate. Elaborations are omitted herein.

Figure 17:
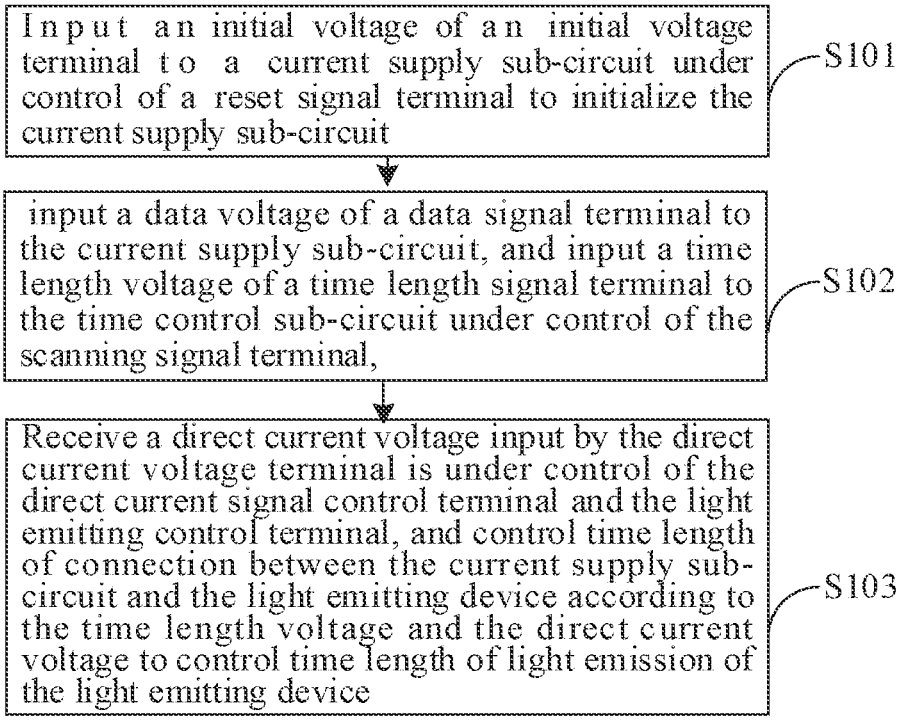
FIG. 17 is a flowchart of a method for driving a pixel circuit according to an embodiment of the present disclosure.

Based on the same concept, an embodiment of the present disclosure also provides a drive method for a pixel circuit. FIG. 17 is a flowchart of the drive method. The method includes the following operations.

In S102, under the control of the scanning signal terminal, a data voltage of the data signal terminal is input to the current supply sub-circuit, and a time length voltage of the time length signal terminal is input to the time control sub-circuit.

In S103, under the control of the direct current signal control terminal and the light emitting control terminal, a direct current voltage input by the direct current voltage terminal is received, and time length of connection between the current supply sub-circuit and the light emitting device is controlled according to the time length voltage and the direct current voltage to control time length of light emission of the light emitting device.

Optionally, as shown in FIG. 17, before the operation that a data voltage of the data signal terminal is input to the current supply sub-circuit and a time length voltage of the time length signal terminal is input to the time control sub-circuit under the control of the scanning signal terminal, the following operation is further included. In S101, an initial voltage of the initial voltage terminal is input to the current supply sub-circuit under the control of the reset signal terminal to initialize the current supply sub-circuit.

The driving process and operating principle of the pixel circuit in the embodiment of the present disclosure have been introduced above, and will not be elaborated herein.

The pixel circuit provided in the embodiment of the present disclosure, under the control of the scanning signal terminal, inputs the data voltage of the data signal terminal to the current supply sub-circuit and inputs the time length voltage of the time length signal terminal to the time control sub-circuit, and under the control of the direct current signal control terminal and the light emitting control terminal, receives the direct current voltage input by the direct current voltage terminal and controls the time length of connection between the current supply sub-circuit and the light emitting device according to the time length voltage and the direct current voltage to control the time length of light emission of the light emitting device. Therefore, in the embodiment of the present disclosure, the light emitting device may be controlled through the data voltage to always operate in a high-current-density region, namely operating in a region where the device is stable in efficiency. In the embodiment of the present disclosure, gray-scale display of the light emitting device may be implemented by combining current and time control methods.

With the application of the embodiments of the present disclosure, at least one of the following beneficial effects may be achieved.

First, since the pixel circuit provided in the embodiment of the present disclosure includes the current supply sub-circuit and the time control sub-circuit, in the embodiment of the present disclosure, the light emitting device may be controlled through the current supply sub-circuit to always operate in a high-current-density region, namely operating in a region where the device is stable in efficiency. Since the time control sub-circuit may control the time length of connection between the current supply sub-circuit and the light emitting device to control the time length of light emission of the light emitting device, in the embodiment of the present disclosure, gray-scale display of the light emitting device may be implemented by combining current and time control methods. In the embodiment of the present disclosure, different time length of light emission corresponds to different gray-scales of the light emitting device.

Second, the light emitting device in the embodiment of the present disclosure is a micro inorganic light emitting diode. Since the pixel circuit in the embodiment of the present disclosure may control the light emitting device through the current supply sub-circuit to always operate in the high-current-density region and implement gray-scale display of the light emitting device by combining the current and time control methods, the pixel circuit in the embodiment of the present disclosure effectively solves the problem that the light emitting efficiency of the micro inorganic light emitting diode changes with the current density under a low current density and a color coordinate also changes with the current density.

Third, according to the embodiment of the present disclosure, the micro inorganic light emitting diode is controlled through the data voltage VdataI to always operate in a high-current-density region, namely operating in a region where the device is stable in efficiency. Then, the transistor T10, the transistor T11, and the transistor T12 are sequentially turned on according to timing, a direct current voltage V1, a direct current V2, and a direct current voltage V3 are input to the second terminal of the first capacitor C2 respectively, and then the first terminal of the second capacitor C2 may be bootstrapped to corresponding voltages, thereby controlling an on state of the first transistor T8 and the time length of light emission of the micro inorganic light emitting diode to finally implement gray-scale display of the micro inorganic light emitting diode by combining current and time control methods. The pixel circuit of the embodiment of the present disclosure remedies the defects of the micro inorganic light emitting diode type light emitting device.

Fourth, in the embodiment of the present disclosure, the direct current V1, the direct current voltage V2, and the direct current voltage V3 are direct current signals shared by the whole screen, and the direct current voltage input to the pixel circuit is selected by using the timing of the direct current signal control sub-terminal (S1), the direct current signal control sub-terminal (S2), and the direct current signal control sub-terminal (S3). Since the direct current signal control sub-terminal (S1), the direct current signal control sub-terminal (S2), and the direct current signal control sub-terminal (S3) are provided by the same set of GOA circuit, the pixel circuit of the embodiment of the present disclosure may be applied to both a driving manner of sequentially turning on the rows one by one and a driving manner of simultaneously turning on all the rows.

Fifth, when the pixel circuit of the embodiment of the present disclosure adopts the row-by-row sequential turn-on manner, the write time of the data voltages VdataI and time length voltages VdataT of the pixels of each row is 1H, only more than ten microseconds, and light may be emitted even if the data voltages VdataI and time length voltages VdataT of the whole screen are not completely written. Therefore, the pixel circuit provided in the embodiment of the present disclosure may be applied to a high-resolution product.

Terms "first" and "second" are only for description and should not be understood to indicate or imply relative importance or implicitly indicate the number of indicated technical features. Therefore, a feature defined by "first" and "second" may explicitly or implicitly indicate inclusion of one or more such features. In the descriptions of the present disclosure, "multiple" means two or more than two, unless otherwise specified.

The above is only part of optional implementation modes of the present disclosure. It is to be pointed out that those of ordinary skill in the art may further make a plurality of improvements and embellishments without departing from the principle of the present disclosure, and these improvements and embellishments shall also fall within the scope of protection of the present disclosure.

What is claimed is:

1. A pixel circuit, comprising a light emitting device, a current supply sub-circuit, and a time control sub-circuit, wherein the current supply sub-circuit is connected to a scanning signal terminal, a data signal terminal, a light emitting control terminal, a first power voltage terminal, the time control sub-circuit, and the light emitting device, and is configured to receive a data voltage of the data signal terminal and provide a drive current for the light emitting device; and the time control sub-circuit is connected to the scanning signal terminal, a time length signal terminal, a second power voltage terminal, a direct current control signal terminal, and a direct current voltage terminal, and is configured to receive a time length voltage of the time length signal terminal and a direct current voltage input by the direct current voltage terminal and control a time length of connection between the current supply sub-circuit and the light emitting device according to the time length voltage and the direct current voltage to control a time length of light emission of the light emitting device.

2. The pixel circuit according to claim 1, wherein the time control sub-circuit comprises a first signal write module and a time length control module;

the first signal write module is connected to the scanning signal terminal, the time length signal terminal, the second power voltage terminal, and the time length control module, and is configured to input the time length voltage of the time length signal terminal to the time length control module under control of the scanning signal terminal; and the time length control module is connected to the direct current control signal terminal, the direct current voltage terminal, and the current supply sub-circuit, and is configured to, under control of the direct current signal control terminal, receive the direct current voltage of the direct current voltage terminal and control the time length of connection between the current supply sub-circuit and the light emitting device according to the time length voltage and the direct current voltage to control the time length of light emission of the light emitting device.

3. The pixel circuit according to claim 2, wherein the time length control module comprises a voltage input module and a switch module;

the voltage input module is connected to the direct current signal control terminal, the direct current voltage terminal, the first signal write module, and the switch module, and is configured to input the direct current voltage of the direct current voltage terminal to the switch module under the control of the direct current signal control terminal; and the switch module is connected to the first signal write module, the current supply sub-circuit, and the voltage input module, and is configured to receive the time length voltage and control the time length of connection between the current supply sub-circuit and the light emitting device according to the time length voltage and the direct current voltage to control the time length of light emission of the light emitting device.

4. The pixel circuit according to claim 3, wherein the voltage input module comprises at least two voltage input sub-units, the direct current signal control terminal comprises at least two direct current signal control sub-terminals, and the direct current voltage terminal comprises at least two direct current voltage sub-terminals;

each voltage input sub-unit corresponds to one of the direct current signal control sub-terminals and one of the direct current voltage sub-terminals; and each voltage input sub-unit has a first terminal connected to the direct current signal control sub-terminal corresponding to the voltage input sub-unit, a second terminal connected to the direct current voltage sub-terminal corresponding to the voltage input sub-unit, and a third terminal connected to the switch module.

5. The pixel circuit according to claim 4, wherein each voltage input sub-unit comprises a transistor; and the transistor has a control terminal connected to the direct current signal control sub-terminal, a first electrode connected to the direct current voltage sub-terminal, and a second electrode connected to the switch module.

6. The pixel circuit according to claim 3, wherein the switch module comprises a first transistor and a first capacitor;

the first transistor has a control terminal which is connected to one end of the first capacitor and the first signal write module, and a first electrode and a second electrode which are connected to the current supply sub-circuit; and the other end of the first capacitor is connected to the voltage input module.

7. The pixel circuit according to claim 2, wherein the first signal write module comprises a second transistor and a third transistor;

the second transistor has a control terminal connected to the scanning signal terminal, a first electrode connected to the time length signal terminal, and a second electrode connected to the time length control module; and the third transistor has a control terminal connected to the scanning signal terminal, a first electrode connected to the second power voltage terminal, and a second electrode connected to the time length control module.

8. The pixel circuit according to claim 1, wherein the current supply sub-circuit comprises a second signal write module, a light emitting control module, and a drive module;

the second signal write module is connected to the scanning signal terminal, the data signal terminal, the time control sub-circuit, and the drive module, and is configured to input the data voltage of the data signal terminal to the drive module under control of the scanning signal terminal;

the light emitting control module is connected to the light emitting control terminal, the first power voltage terminal, the second signal write module, the drive module, the time control sub-circuit, and the light emitting device, and is configured to connect the first power voltage terminal with the drive module and connect the time control sub-circuit with the light emitting device under control of the light emitting control terminal; and the drive module is connected to the first power voltage terminal, the light emitting control module, and the second signal write module, and is configured to provide the drive current for the light emitting device.

9. The pixel circuit according to claim 8, wherein the second signal write module comprises a fourth transistor and a fifth transistor;

the fourth transistor has a control terminal connected to the scanning signal terminal, a first electrode connected to the data signal terminal, and a second electrode connected to the light emitting control module and the drive module; and the fifth transistor has a control terminal connected to the scanning signal terminal, a first electrode connected to the drive module, and a second electrode connected to the time control sub-circuit and the drive module.

10. The pixel circuit according to claim 8, wherein the drive module comprises a sixth transistor and a second capacitor;

the sixth transistor has a control terminal connected to the second signal write module, a first electrode connected to the second signal write module and the light emitting control module, and a second electrode connected to the time control sub-circuit and the second signal write module; and one end of the second capacitor is connected to the first power voltage terminal, the other end of the second capacitor is connected to the second signal write module and the control terminal of the sixth transistor.

11. The pixel circuit according to claim 8, wherein the light emitting control module comprises a seventh transistor and an eighth transistor;

the seventh transistor has a control terminal connected to the light emitting control terminal, a first electrode connected to the first power voltage terminal, and a second electrode connected to the drive module and the second signal write module; and the eighth transistor has a control terminal connected to the light emitting control terminal, a first electrode connected to the light emitting device, and a second electrode connected to the time control sub-circuit.

12. The pixel circuit according to claim 1, further comprising a reset module which is connected to a reset signal terminal, an initial voltage terminal, and the current supply sub-circuit and is configured to input an initial voltage of the initial voltage terminal to the current supply sub-circuit under control of the reset signal terminal to initialize the current supply sub-circuit.

13. The pixel circuit according to claim 12, wherein the reset module comprises a ninth transistor; and the ninth transistor has a control terminal connected to the reset signal terminal, a first electrode connected to the initial voltage terminal, and a second electrode connected to the current supply sub-circuit.

14. A display substrate, comprising a plurality of pixel units arranged in an array, wherein each pixel unit comprises the pixel circuit according to claim 1.

15. A display device, comprising the display substrate according to claim 14.

16. A method for driving a pixel circuit, configured to drive the pixel circuit claim 1 and the method comprises:

inputting the data voltage of the data signal terminal to the current supply sub-circuit, and inputting the time length voltage of the time length signal terminal to the time control sub-circuit under control of the scanning signal terminal; and under control of the direct current signal control terminal and the light emitting control terminal, receiving the direct current voltage input by the direct current voltage terminal, and controlling the time length of connection between the current supply sub-circuit and the light emitting device according to the time length voltage and the direct current voltage to control the time length of light emission of the light emitting device.

17. The method according to claim 16, wherein before the inputting the data voltage of the data signal terminal to the current supply sub-circuit and inputting a time length voltage of the time length signal terminal to the time control sub-circuit under the control of the scanning signal terminal, the method further comprises:

inputting an initial voltage of the initial voltage terminal to the current supply sub-circuit under the control of the reset signal terminal to initialize the current supply sub-circuit.

* * * * *